United States Patent [19]

Poff et al.

[11] 4,039,174

[45] Aug. 2, 1977

[54] RELINE TOWER FOR A METALLURGICAL FURNACE

[75] Inventors: Clifford A. Poff, Pittsburgh, Pa.; William J. Hively, Salem; Kenneth J. Novacich, Poland, both of Ohio

[73] Assignee: Fordees Corporation, Leetonia, Ohio

[21] Appl. No.: 672,518

[22] Filed: Mar. 31, 1976

[51] Int. Cl.[2] ..... C21C 5/44

[52] U.S. Cl. ..... 266/281

[58] Field of Search ..... 266/281, 287; 212/46 B, 212/144

[56] References Cited

U.S. PATENT DOCUMENTS

| | | | |
|---|---|---|---|
| 3,045,837 | 7/1962 | Liebherr et al. | 212/46 B |
| 3,194,412 | 7/1965 | Kerridge | 212/46 B |
| 3,534,867 | 10/1970 | Johnston et al. | 212/144 |

FOREIGN PATENT DOCUMENTS

| | | | |
|---|---|---|---|
| 1,458,895 | 2/1969 | Germany | 266/281 |
| 40-24881 | 1/1964 | Japan | 266/281 |

*Primary Examiner*—Gerald A. Dost

*Attorney, Agent, or Firm*—Brown, Murray, Flick & Peckham

[57] ABSTRACT

A reline tower is supported by a wheeled car for movement along rails while the tower extends in a vertically-spaced relation below the bottom opening in Q-BOP type of metallurgical furnace which is supported for pivotal movement about a horizontal axis. When the tower is supported on the car for a tilting type of pivotal movement, a control system synchronizes tilting movement of the tower in relation to both displacement by the car along the rails and pivotal movement of the metallurgical furnace whereby the tower is moved into a generally upright position while the upper end of the tower extends within the metallurgical furnace. The entire tower is either pivotally attached to the wheeled car or the tower is divided into a lower straight section carried by the car to pivotally support an upper tower section. In another embodiment, the tower consists of an upper tower section and a lower tower section made up of superimposed pairs of half tower sections that are hinged together to vertically displace the upper tower section into the metallurgical furnace. According to another embodiment, the tower consists of a plurality of sections receivable one within the other in a vertically-telescoping manner. Stops limit upward displacement of the tower sections relative to each other by the cable of a winch. In another embodiment, the tower is assembled from discrete sections that are separately supported by horizontal arms extending from a vertical support post on the car. A piston and cylinder assembly supported either by the car or independent of the car lifts one tower section to an elevation so that a second tower section can be positioned beneath it by pivotal movement of the support arms.

28 Claims, 11 Drawing Figures

RELINE TOWER FOR A METALLURGICAL FURNACE

BACKGROUND OF THE INVENTION

This invention relates to an improved construction and relationship of parts to form a reline tower employed for supporting workmen and materials within a metallurgical furnace while replacing the refractory lining therein.

While the present invention is not so limited, it is particularly useful for facilitating the relining of a metallurgical furnace of the type commonly referred to in the art as a Q-BOP furnace. The usual Q-BOP furnace is a bottom-blown oxygen steelmaking furnace in the form of a large open-top vessel having a circular cross section and lined with refractory brickwork. When a bottom wall section, containing tuyeres, is removed for a relining operation, Q-BOP furnace becomes an open-ended vessel. Because of the physical size of the furnace, a tower or scaffolding is needed to support workment and materials at various elevations within the furnace to replace the refractory brick lining.

The useful life of the refractory brick is limited because it is eroded away during the steelmaking operation. The relining operation should be carried out in a rapid and efficient manner so as to minimize the time required to return the furnace back into service. In a given steelmaking facility, it is the usual practice to employ a plurality of Q-BOP furnaces so that, for example, while one furnace is undergoing a relining operation, other furnaces are used to continue the steelmaking operation. This, of course, necessitates the continued availability of a mill crane for the steelmaking operation because ladles of molten metal must be transported to the Q-BOP furnace and other essential functions carried out through the use of the crane. It is, therefore, highly undesirable to require the services of the mill crand during relining operations for a metallurgical furnace. Most known designs of reline towers demand either continuous service or partial service by an overhead crane during the actual relining operation. Typically, the services of an overhead crane have been utilized to assemble a reline tower in a piece-by-piece fashion within the furnace or otherwise manipulate and position a tower for use within the furnace.

SUMMARY OF THE INVENTION

It is an object of the present invention to provide an apparatus in the form of an elongated tower which is supported by a wheeled car below a metallurgical furnace for movement into a position to be inserted through a bottom opening in the furnace without requiring the services of an overhead crane or the like.

It is a further object of the present invention to provide an elongated tower supported by a wheeled car for movement along a floor beneath each of a plurality of metallurgical furnaces to facilitate replacing the refractory lining therein without requiring an overhead crane which is usually needed to extend and use the tower within the metallurgical furnace.

It is another object of the present invention to provide an improved tower to carry out relining operations within a metallurgical furnace wherein the tower is constructed and arranged on a wheeled car which contains all the necessary facilities to erect and/or position a tower to extend within a metallurgical furnace after the tower is transported beneath a furnace from a preselected storage area.

It is still another object of the present invention to provide a control system to synchronize the movable positioning of a reline tower both horizontally and vertically for arranging the tower within a metallurgical furnace while the furnace undergoes rotational positioning about its usual horizontal support axis.

It is still another object of the present invention to provide an improved tower construction to carry out relining operations for a metallurgical furnace wherein the tower consists of tower sections which are constructed and arranged for rapid repositioning or assembly to form an extended tower which projects into a metallurgical furnace.

In one form of the present invention there is provided an apparatus for facilitating the relining of a metallurgical furnace having a bottom opening spaced above a floor, the furnace being supported for pivotal movement by a furnace drive about a horizontal axis, the apparatus including the combination of rails extending along the floor, a wheeled car adapted to move along the rails while spaced vertically below the bottom opening in the furnace, a drive for moving the wheeled car along the rails, an elongated tower having an extended height to project into the metallurgical furnace by passing through the bottom opening therein while the tower is supported by the wheeled car, hinge means for pivoting a selected length of the tower about a horizontal axis lying below the bottom opening in the furnace in a manner for vertically displacing the upper end of the tower, drive means for pivoting the selected length of the tower about the horizontal axis of the hinge means for displacing the upper end of the tower from an elevation lying below the bottom opening in the furnace to a vertically-extended position whereby the tower extends into the furnace, and means for controlling the drive means.

In one form, the aforesaid means for controlling the drive means includes position transducers to produce electrical signals corresponding to displacements of the wheeled car along the rails and electrical signals corresponding to pivotal movement of the metallurgical furnace about the horizontal axis, a differential amplifier means receiving the electrical signals from the position transducers for producing a control signal, and a controller responsive to the control signal for controlling the drive means to pivot the selected length of the tower.

The aforesaid elongated tower, according to one embodiment, is attached for pivotal movement by the hinge means to the wheeled car; while in another embodiment, the tower is divided into upper and lower sections that are connected together by the hinge means for pivotal movement about an axis spaced below the bottom of the metallurgical furnace. In still another embodiment of the invention, the elongated tower includes upper and lower tower sections each having rigid corner posts interconnected by brace members, the lower tower section including a first pair of half tower sections each pivotally connected to the wheeled car for positioning the half tower sections into a vertically-extended and side-by-side relation, a second pair of half tower sections connected by the aforesaid hinge means to oposite sides of the upper tower section, pivot means for interconnecting the half tower sections of the first pair with the respective ones of the underlying half tower sections of the second pair, and means for horizontally moving the pivot means for displacing the half tower sections of each pair relative to one another to thereby vertically displace the upper tower section relative to the furnace.

According to a further embodiment of the present invention, the elongated tower takes the form of a plurality of tower sections interconnected in an end-to-end relation for defining a tower assembly having an extended height to project into the metallurgical furnace, support means carried by the wheeled car to horizontally position each tower section in a successive manner into a preselected location on the car lying below the bottom opening in the furnace, and drive means for vertically displacing a tower section for superimposed engagement and supported by an underlying tower section after horizontal positioning thereof by the aforesaid support means into the preselected location, the aforesaid drive means for vertically displacing the tower section preferably takes the form of a piston and cylinder assembly that is supported either by the wheeled car or within a pit in the floor located beneath the bottom opening in the metallurgical furnace.

In a still further embodiment of the present invention, the tower takes the form of a plurality of elongated tower sections receivable one within the other in a vertically-telescoping manner to define a tower having an extended height to project into the metallurgical furnace, stop means for limiting the upward vertical displacement of the tower sections relative to each other, cable means to vertically extend the plurality of tower sections in a telescoping manner and a winch including a drum coupled to the cable means for extending the tower sections.

These features and advantages of the present invention as well as others will be more fully understood when the following description is read in light of the accompanying drawings, in which.

Figure 1:
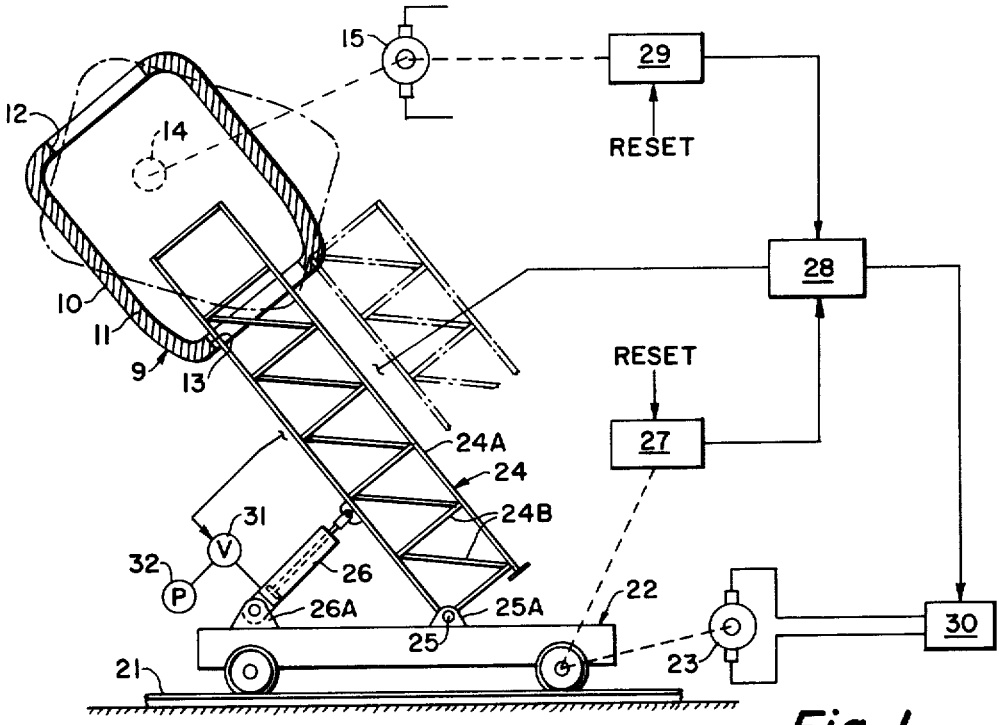
FIG. 1 is an elevational view of a first embodiment of a reline tower according to the present invention.
Figure 4:
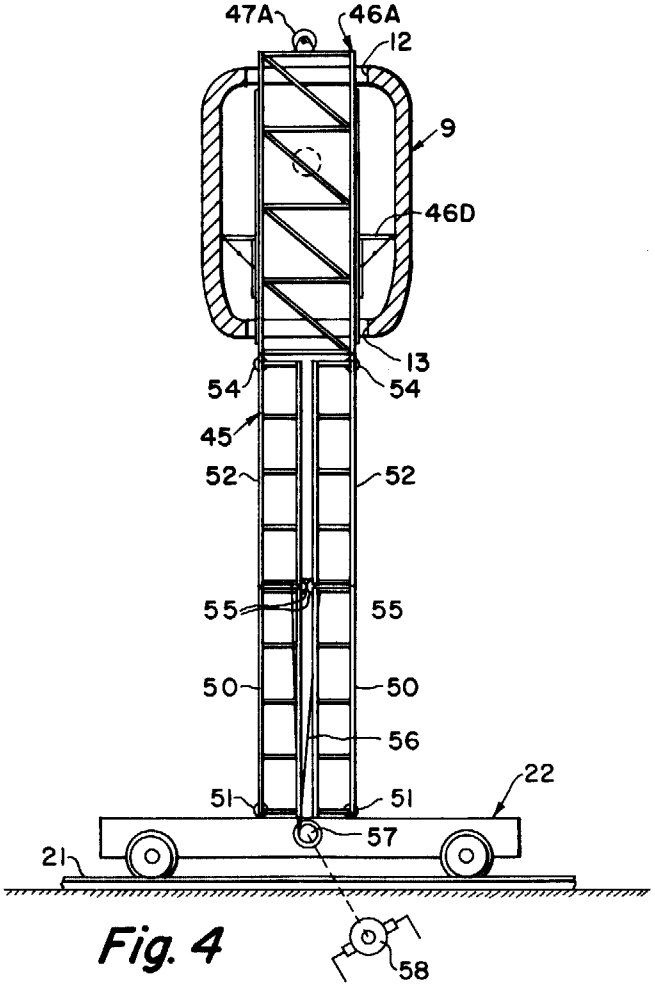
FIG. 4 is a view of the reliner tower shown in FIG. 3 but in an operative relation to carry out a relining operation.
Figure 3:
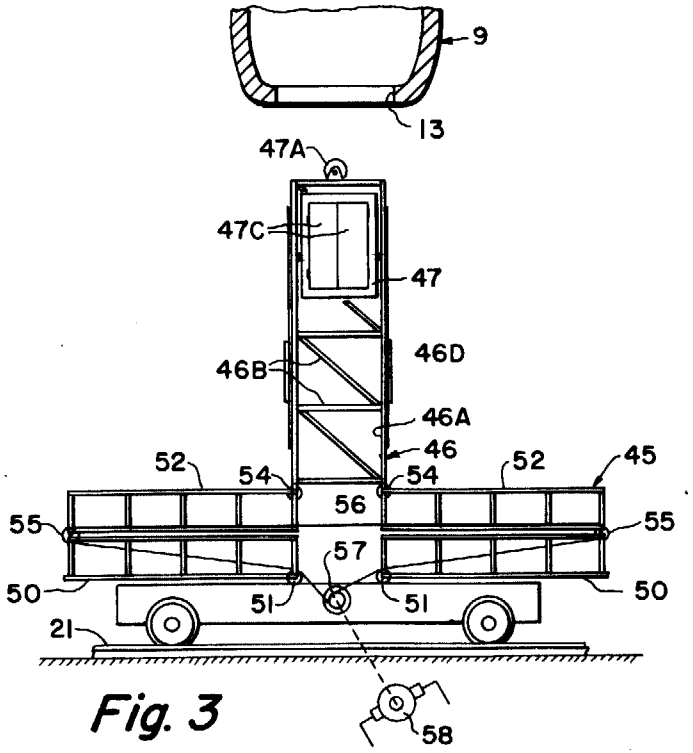
FIG. 3 is an elevational view of a reline tower according to a third embodiment of the present invention with parts forming the tower arranged for movement beneath a metallurgical furnace.

As shown diagrammatically in FIGS. 1, 3 and 4, a metallurgical furnace 9 in the form of a Q-BOP furnace includes a metal shell 10 and a lining 11 of refractory brickwork. The furnace has circular openings 12 and 13 at its top and bottom, respectively. The furnace is supported by trunnion shafts 14 that are carried at a spaced location above a floor for pivotal movement of the metallugical furnace about a horizontal axis by a furnace drive that includes a motor 15. The height at which the furnace is supported above the floor varies from steelmaking facility-to-steelmaking facility.

The floor includes spaced-apart parallel rails 21 that may, for example, extend directly beneath a plurality of spaced-apart Q-BOP furnaces. A wheeled car 22 is propelled along the rails 21 by a drive that includes a motor 23. If desired, the wheeled car may be propelled along the rails by a separate locomotive or truck. As shown in FIG. 1, an elongated tower 24 includes rigid corner posts 24A that are connected together by brace members 24B. The corner posts at one side of the tower are joined by a hinge pin 25 to upstanding bracket plates 25A that are welded or otherwise secured to the top surface of the wheeled car. The hinge pin 25 extends transversely to the extended length of the car. The tower is pivotally displaced about a horizontal axis extending along the hinge pin by a piston and cylinder assembly 26 that is supported by a clevis mounting 26A on the wheeled car. The rod end of the piston and cylinder assembly is secured to the side of the tower 24 at a spaced location above the hinge pin 25.

In FIG. 1, the reline tower is a rigid structure throughout its entire height. The tower is pivotally tilted by the piston and cylinder assembly 26 at an angle of, for example, 30° to the horizontal to thereby vertically displace the upper end of the tower to an elevation for passage into the bottom opening of the metallurgical furnace after the furnace has been rotated by the drive motor 15 to the phantom-line position shown in FIG. 1. When the tower and metallurgical furnace have been positioned in this manner, the tower is moved in a synchronous relation with rotational movement of the metallurgical furnace by a control system according to the present invention. In one form, this control system includes a position transducer 27 which is coupled to the wheels of the car 22 for providing an electrical signal corresponding to a displacement of the car along the rails relative to the metallurgical furnace or from a preselected position corresponding essentially to the phantom-line position of the tower and metallurgical furnace shown in FIG. 1. The position transducer is of a well-known type which is capable of being reset to identify the start position of the car. The output signal from the position transducer 27 is fed to a differential amplifier 28 which also receives the output signal from a position transducer 29 driven by the drive motor 15 for the furnace. The differential amplifier 28 provides two output signals, the first of which is delivered by a line connected to a motor control 30 for controlling motor 23 while the second output signal from amplifier 28 is usd as a control signal for a valve 31 that, in turn, controls the flow of hydraulic fluid from a pump 32 to the piston and cylinder assembly 26. The two output signals from amplifier 28 are used to bring about horizontal movement of the car and tilting movement of the tower in synchronous relation with pivotal movement of the metallurgical furnace so that the tower is tilted to a vertically-extended relation within the furnace when the top and bottom openings of the furnace are vertically aligned.

Figure 2:
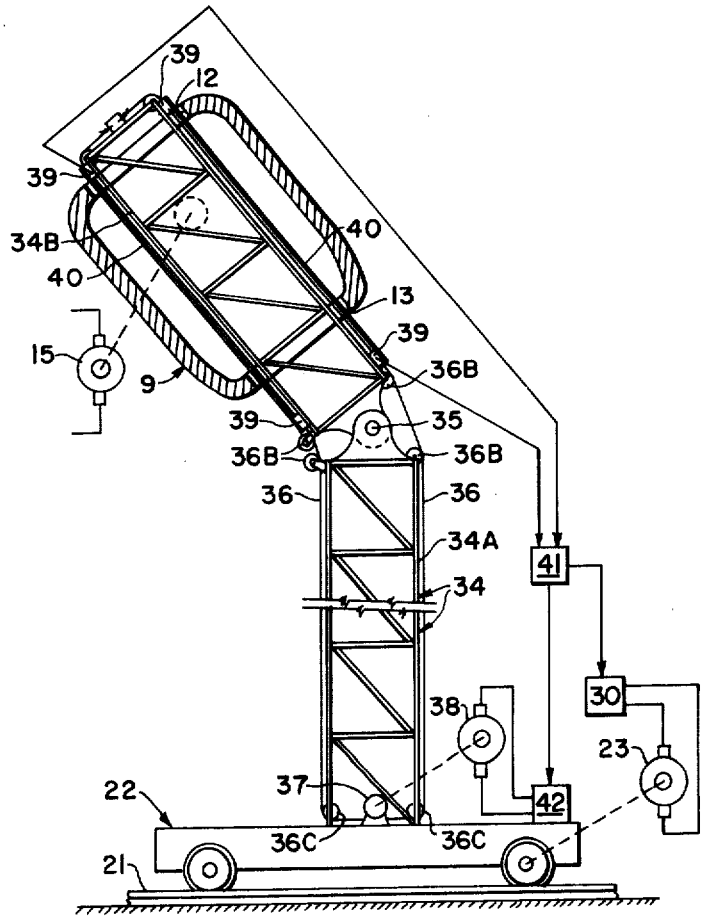
FIG. 2 is an elevational view of a reline tower according to a second embodiment of the present invention.

According to the second embodiment of the present invention as illustrated in FIG. 2, the wheeled car 22 is supported on the rails 21 previously described in regard to FIG. 1. The car 22 supports a reline tower 34 which consists of a lower tower section 34A that is rigidly supported by the car and extends vertically therefrom to an elevation which is spaced below the lower end of the metallurgical furnace 9. An upper tower section 34B is rigid along its length but the upper and lower sections are connected together by a hinge pin 35 in such a manner that the upper tower section is pivotally displaced about a horizontal axis lying midway between the corner posts at opposite sides of the lower tower section. The ends of a cable 36 are secured to the opposite sides of the upper tower section to pivotally move the upper tower section. The cable is attached to the sides of the upper tower section which are parallel with the horizontal axis of the hinge pin 35. The cable extends downwardly along the opposed sides of the upper tower section. The cable is guided by pulleys 36B to pass downwardly along the length of the lower tower section and around pulleys 36C from where the cable extends to a drum 37 forming part of a driven winch that includes a motor 38. To position the tower 34 for a relining operation, the upper tower section is pivoted from an inclined position to a generally vertical position. This may be accomplished by employing a control system using position transducers to carry out the desired synchronizing movement in the same manner as previously described in regard to FIG. 1.

A different form of control system is shown in FIG. 2. This control system employs load cells 39 or other forms of strain gages attached at opposite sides of the upper reline tower section so that each load cell is engaged by a pressure plate 40 which is adapted to be engaged by the edge surfaces of the top and bottom openings 12 and 13 in the metallurgical furnace. The pressure plates 40 and load cells 39 are arranged in such a manner that by energizing the motor 15 to slowly rotate the metallurgical furnace, the load cells 39 provide an output signal when the furnace contacts and develops a force on the upper section of the reline tower. An output signal from one or more of the load cells 39 is fed to a differential amplifier 41 which produces two output signals. One output signal is delivered to a motor controller 42 that, in turn, controls the motor 38 of the winch. A second output signal from the differential amplifier 41 is delivered to the motor controller 30 for controlling the motor 23 used to propel the wheeled car along the tracks. In this way, pivotal movement of the furnace is detected by the load cells. The signal from the load cells is used to provide control signals to synchronously displace the wheeled car and pivot the upper tower section until the tower extends vertically within the furnace.

FIGS. 3 and 4 illustrate a third embodiment of the present invention wjherein instead of synchronizing tilting movement and displacement of a tower relative to rotational movement of the metallurgical furnace, the reline tower is constructed and arranged in such a manner that it is positioned by the wheeled car 22 into a stationary location directly beneath the bottom opening 13 in the metallurgical furnace. As shown in FIGS. 3 and 4, the wheeled car 22 supports a reline tower assembly 45 that includes an upper tower section 46 having rigid corner posts 46A that are connected together by brace members 46B. Each of the various embodiments of a reline tower according to the present invention includes an elevator cage 47 that is moved vertically within the tower by a hoist 47A carried upon the top of the tower. The tower includes elevator access doors 46C as shown in FIG. 3. A work platform 46D is vertically movable along the outer surface of the tower to support workmen and materials within the furnace during the relining operation.

The tower 45 further includes a lower tower section made up of a first pair of half tower sections 50 each pivotally connected by hinge pins 51 at their outer opposite sides to the wheeled car 22. A second pair of half tower sections 52 is connected for pivotal movement at their upper ends by hinge pins 54 to the opposite sides of the lower end of the upper tower section 46. Hinge pins 55 interconnect the half tower sections 52 with the respective ones of the underlying half tower sections 50. A cable 56 extends between the hinge pins 55 where pulleys are rotatably supported for guiding the cable between the hinge pins and toward a drum 57 forming part of a winch having a drive motor 58. By energizing the drive motor 58, the drum 57 is rotated to coil equal increments of cable and thereby draw the two hinge pins 55 toward each other whereby the half tower sections of each pair are moved into a vertically-extended and side-by-side relation as clearly shown in FIG. 4. This bring about vertical displacement of the upper tower section from an elevation essentially below the metallurgical furnace to an elevation whereby it extends within the metallurgical furnace for carrying out the desired relining operation.

Figure 5:
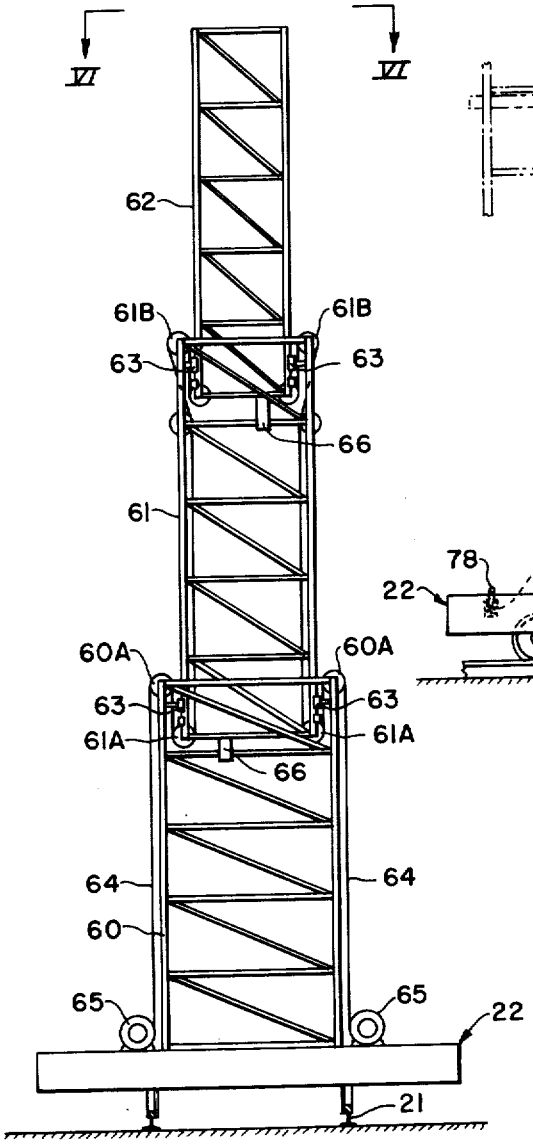
FIG. 5 is an elevational view of a reline tower according to a fourth embodiment of the present invention.
Figure 6:
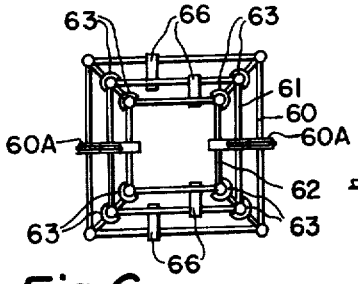
FIG. 6 is a sectional view taken along line VI—VI of FIG. 5.

Another form of a vertically-extended reline tower is shown in FIGS. 5 and 6. The wheeled car 22 rigidly supports a lower tower section 60 that includes rigid vertical corner posts connected together by brace members to form a tower section that is rectangular in cross section. An intermediate tower section 61 includes rigid corner posts connected together by brace members to form a tower section that is rectangular in cross section but with slightly smaller transverse dimensions so that it can pass downwardly within the lower tower section 60 in a telescoping manner. An upper tower section 62 also includes rigid corner posts connected together by brace members to form a tower section of rectangular cross section having smaller physical dimensions so that the upper tower section can fit within the middle tower section 61 in a telescoping manner. Each of the tower sections 61 and 62 is vertically moved against fixed stops 63 by cables 64 that are connected at their ends to separate drums 65 of driven winches. The cables 64 pass from the drums 65 upwardly to pulleys 60A supported on the upper ends of the tower section 60. The cables then pass downwardly to pulleys 61A supported on the lower end of the tower section 61 and then upwardly along the length of the tower section 61 to the upper end thereof where pulleys 61B receive the cables. The cables then pass downwardly to the lower end of the tower section 62 where the cables are attached thereto. The stops 63 are supported at selected positions by the lower sections 60 and 61 so that a sufficient length of the interfitting tower section exists to stabilize one tower section relative to the other. In addition to the stops 63, pivotal lock plates or clamps 66 are carried by the lower ends of the tower sections 61 amd 62 for interlocking engagement with horizontally-arranged braced members.

Figure 8:
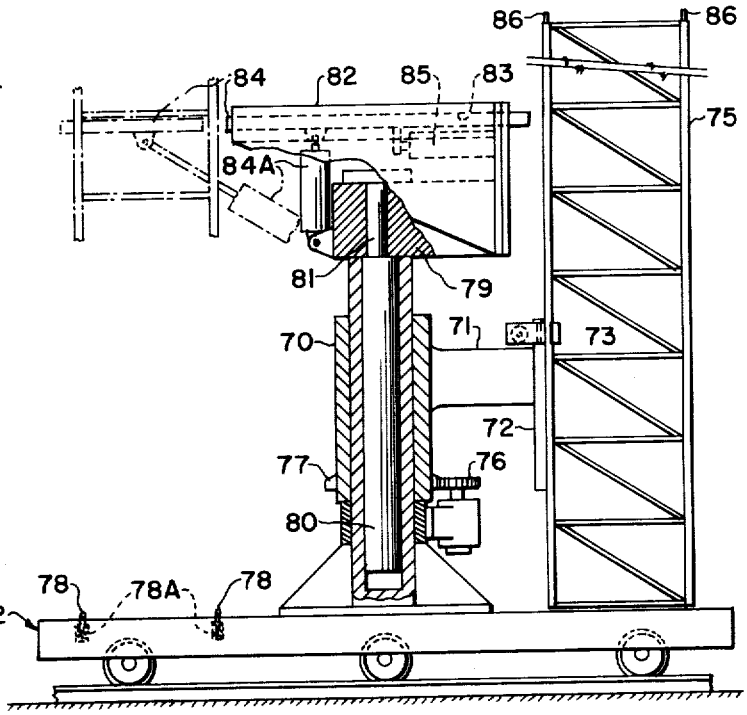
FIG. 8 is an elevational view, partly in section, of the reliner tower shown in FIG. 7.
Figure 9:
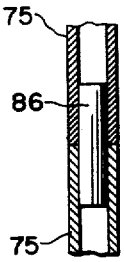
FIG. 9 is a sectional view illustrating the interconnected relation between sections forming the reline tower shown in FIGS. 7 and 8.
Figure 7:
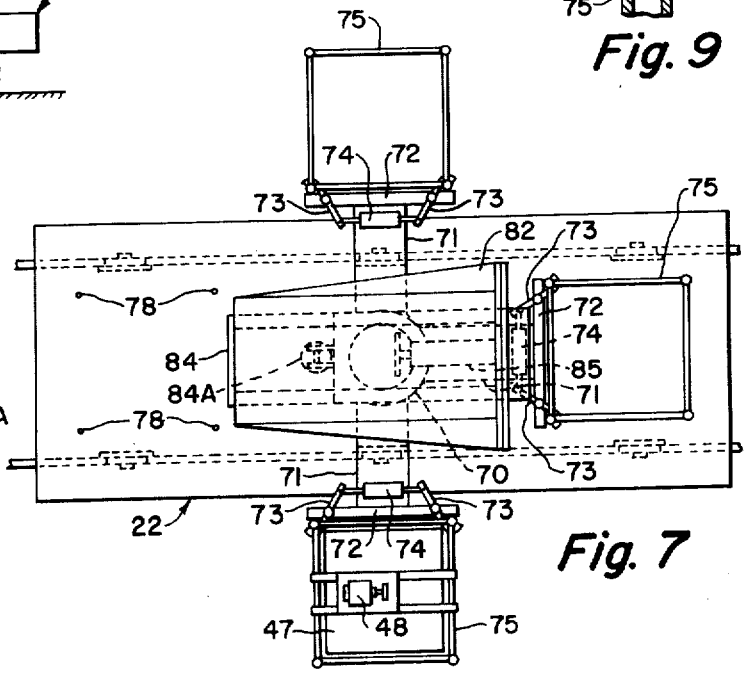
FIG. 7 is a plan view of a fifth embodiment of the reline tower according to the present invention.

FIGS. 7–9 illustrate a further embodiment of a reline tower according to the present invention. According to this embodiment, the wheeled car 22 rotatably supports a vertically-arranged sleeve 70. The sleeve 70 supports three radially-extended support arms 71, each of which, in turn, carries a vertical support plate 72. Clamps 73 are supported for pivotal movement at opposite sides of the plate 72. The cylinder portion of a piston and cylinder assembly 74 is supported at the outer end of each radial arm 71 in such a manner that piston rods extending from each end of the cylinder portion are connected at their outer ends to the clamps 73. The clamps 73 are used to releasably support a rigid tower section 75 to form part of a reline tower, there being three tower sections 75 supported by the radial arms 71. Each tower section includes rigid corner posts connected together by brace members. One tower section 75 includes the elevator cage 47 and hoist 48. The sleeve 70 is rotated about a vertical axis by a motor-driven worm 76 in mesh with a gearwheel 77 secured to the sleeve 70. The rotational movement of the sleeve 70 is used to position a reline tower section carried by one of the radial arms 71 on locating pins 78 that are spaced apart and extend vertically from the car 22 in a manner corresponding to the spacing between the corner posts of a reline tower section. The pins 78 define a predetermined positioning of a reline tower section which is to be elevated by a drive member 79. The pins have chamfered ends and urged by spring 79A to extend from the car. The drive member 79 includes a fluid-actuated piston and cylinder assembly 80 that is concentrically arranged within the sleeve 70 for rotation about a vertical axis. Telescoping pistons may be used in place of a single piston.

The rod end of the piston and cylinder assembly 80 is secured to a radially-extending plate 81 that is connected to spaced-apart side plates 82 having opposed slots 83 that define guide surfaces for an extendible tongue plate 84. This tongue plate is slidable along the slots 83 by a piston and cylinder assembly 85 in such a manner that the tongue plate projects horizontally from the support plate 82 in a cantilever fashion. A piston and cylinder assembly 84A is used to support the extended end of the tongue plate 84 because it is used to engage and support a tower section when located on the pins 78. However, the drive member 79 is first rotated about a vertical axis so that the tongue plate is extendible below horizontal braces of each side of a tower section while located on the pins 78. The piston and cylinder assembly 80 is employed to lift the tower section vertically to a sufficient height so that a second tower section can be positioned by a support arm 71 on the pins 78 beneath the elevated tower section. After this occurs, the elevated tower section is lowered so that pins 86 projecting from the posts extend into recesses in the posts of the other tower section, as best shown in FIG. 9. After these two tower sections are interlocked in a superimposed manner, the tongue plate 84 is retracted by energizing the piston and cylinder assembly 85 and then the piston and cylinder assembly 80 is energized to lower the tongue plate down to its original starting position. The piston and cylinder assembly 85 is again energized to extend the tongue plate beneath a brace member at opposite sides of the lower tower section. After this occurs, the piston and cylinder assembly 80 is again energized to lift both the lower tower section and the upper tower section to a sufficient height so that the radial arms 71 can again be positioned to locate the third tower section on pins 78. After this occurs, the piston and cylinder assembly 80 is operated to lower the tower sections carried thereby so that the pins 86 projecting from their posts pass into the posts of the elevated tower section. The reline tower now defines a sufficient extended height whereby its upper end extends through the bottom opening of a metallurgical furnace and projects to a sufficient height therein to carry out the desired relining operation.

Figure 10:
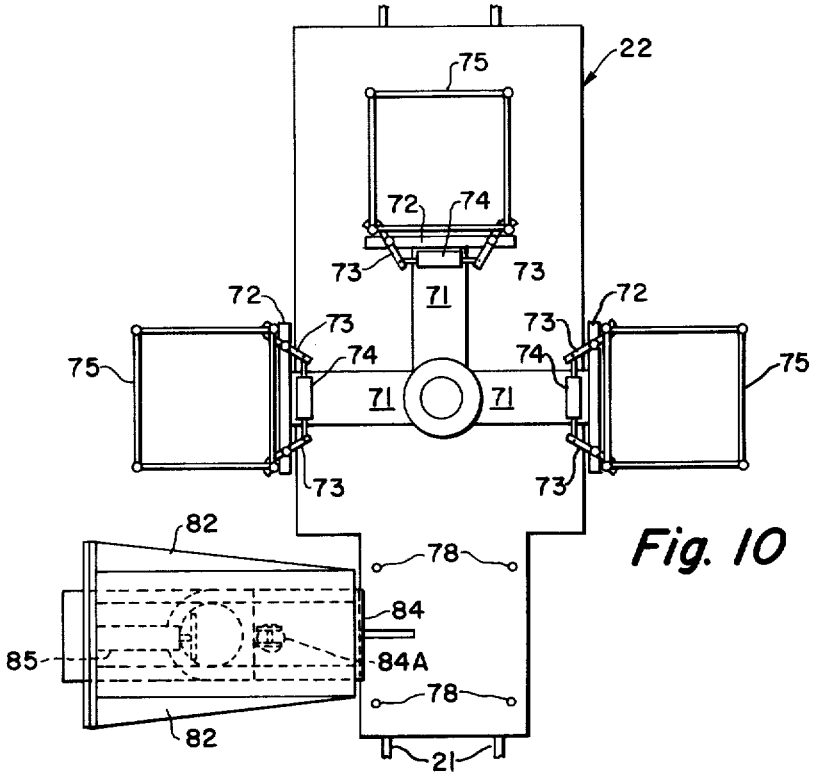
FIG. 10 is a plan view of a sixth embodiment of the reline tower according to the present invention.
Figure 11:
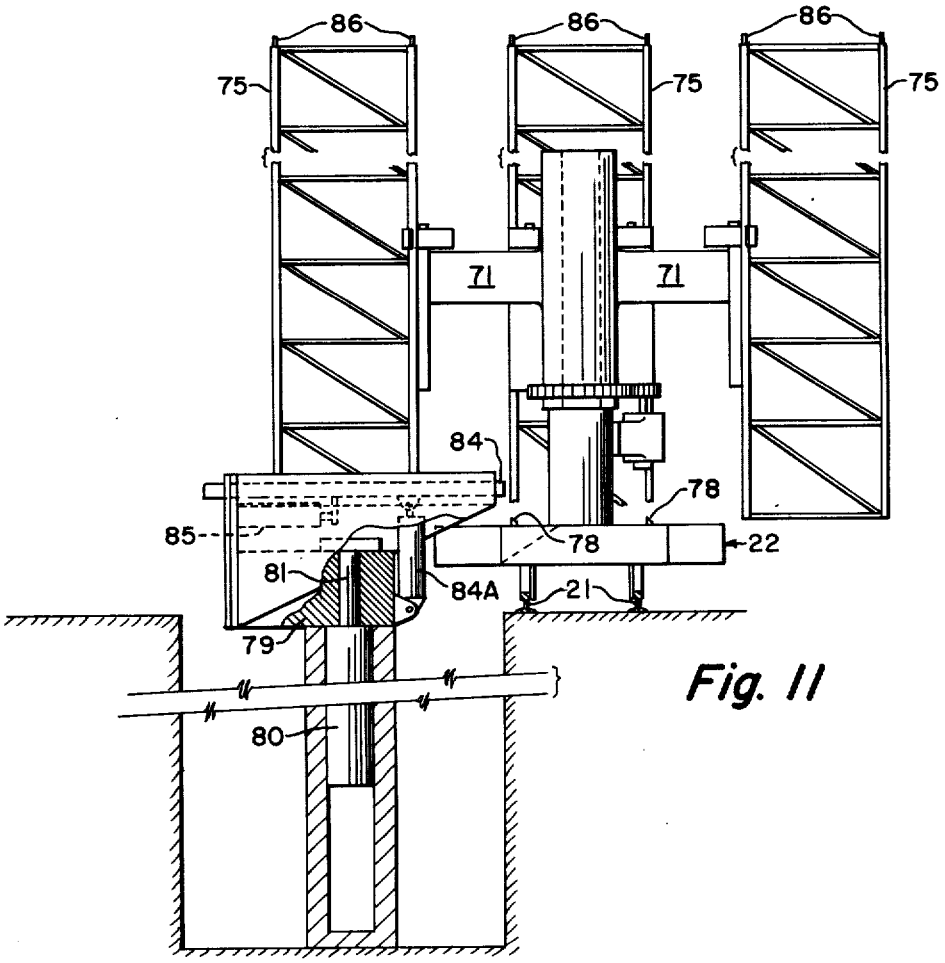
FIG. 11 is an elevational view, partly in section, of the reline tower shown in FIG. 10.

FIGS. 10 and 11 illustrate a still further embodiment of the present invention which differs from that already described in regard to FIGS. 7-9 only with respect to the location of suppoort for the drive member 79. In this regard, as shown in FIGS. 10 and 11, a piston and cylinder assembly 80A is supported within a pit formed in the floor in such a manner that the tongue 84 when extended by piston and cylinder assembly 85 passes beneath a brace member at opposite sides of a tower section while located on pins 78 and supported by the car. By retracting the piston and cylinder assembly 80A, the wheeled car can pass along the rails above the tongue. By arranging the piston and cylinder assembly 80A within a pit to extend below fllor level, the possible need to employ telescoping piston and cylinder assemblies can be avoided.

Although the invention has been shown in connection with certain specific embodiments, it will be readily apparent to those skilled in the art that various changes in form and arrangement of parts may be made to suit requirements without departing from the spirit and scope of the invention.

What is claimed is:

1. An apparatus for facilitating the relining of a metallurgical furnace having a bottom opening spaced above a floor, said furnace being supported for pivotal movement about a horizontal axis by a furnace drive, said apparatus including the combination of:

rails extending along said floor, a wheeled car adapted to move along said rails while spaced vertically below the bottom opening in said metallurgical furnace, a drive for moving said wheeled car along said rails, an elongated tower having an extended height to project into said metallurgical furnace by passing through the bottom opening thereof while the tower is supported by said wheeled car, hinge means for pivoting a selected length of said tower about a horizontal axis lying below the bottom opening in the furnace in a manner to vertically displace the upper end of the tower, drive means for pivoting the selected length of the tower about the horizontal axis of said hinge means for displacing the upper end of the tower from an elevation lying below the bottom opening in the metallurgical furnace to a vertically-extended position whereby the tower extends into the furnace, and means for controlling said drive means.

2. The apparatus according to claim 1 wherein said elongated tower includes rigid corner posts each having a length corresponding essentially to the vertical height of the tower, brace members for supporting said posts in a generally parallel and spaced-apart relation, and wherein said hinge means pivotally interconnects the corner posts at one side of the tower with said wheeled car.

3. The apparatus according to claim 1 further comprising a work platform adapted to pass through said bottom opening while supported by said elongated tower for positioning within the metallurgical furnace, and elevator means adapted for movement with said tower between said wheeled car and said furnace.

4. The apparatus according to claim 1 wherein said means for controlling said drive means includes a first position transducer to produce an electrical signal corresponding to displacements of said wheeled car along the rails relative to said furnace, a second position transducer to produce an electrical signal corresponding to the pivotal movement of the metallurgical furnace about a horizontal axis by said furnace drive, a differential amplifier means receiving the electrical signals from said first and second position transducers for producing a control signal, and a controller responsive to said control signal for controlling said drive means to pivot the selected length of the tower.

5. The apparatus according to claim 4 further comprising means responsive to said control signal for controlling movement of said wheeled car along the rails in a predetermined synchronous relation with pivotal movements by said furnace and said tower.

6. The apparatus according to claim 1 wherein said elongated tower includes upper and lower tower sections each having rigid corner posts interconnected by brace members, the upper tower section being pivotally connected by said hinge means to the lower tower section, and said lower tower section being rigidly supported to extend vertically from said wheeled car.

7. The apparatus according to claim 6 wherein said hinge means is constructed and arranged to pivotally interconnect the upper and lower tower sections for pivotal movement about a horizontal axis lying midway between the corner posts at opposite sides of the tower sections, and wherein said drive means includes a cable having the ends thereof connected to the upper tower section at the respective opposite sides which extend parallel to the horizontal pivot axis of said hinge means, and a winch having a driven drum encircled by at least one convolution of said cable.

8. The apparatus according to claim 7 wherein said wheeled car supports said winch, and said apparatus further includes means supported by said tower to guide said cable along the extended length of the tower.

9. The apparatus according to claim 1 wherein said means for controlling said drive means includes load responsive means supported at opposite sides of said tower to produce at least one electrical signal corresponding to a force imposed on the tower by the walls of said furnace in response to pivotal movement thereof by said furnace drive, a first controller responsive to said at least one electrical signal to control said drive means, and a second controller responsive to said at least one electrical signal to control movement of said wheeled car by said drive.

10. The apparatus according to claim 1 wherein said elongated tower includes upper and lower tower sections each having rigid corner posts interconnected by brace members the lower tower section including a first pair of half tower sections each pivotally connected to said wheeled car for positioning of the half tower sections into a vertically-extended and side-by-side relation, a second pair of half tower sections connected by said hinge means to opposite sides of said upper tower section, pivotal means for interconnecting the half tower sections of the first pair with a respective one of the underlying half tower section of the second pair, and means for horizontally moving said pivot means to displace the half tower sections of each pair relative to one another to thereby vertically displace said upper tower section relative to said furnace.

11. An apparatus for facilitating the relining of a metallurgical furnace having a bottom opening spaced above a floor, said furnace being supported for pivotal movement about a horizontal axis by a furnace drive, said apparatus including the combination of:

rails extending aling said floor, a wheeled car adapted to move along said rails while spaced vertically below the bottom opening in said metallurgical furnace, a drive for moving said wheeled car along said rails, an elongated tower including a plurality of tower sections interconnected in an end-to-end relation for defining a tower assembly having an extended height to project into said metallurgical furnace by passing through the bottom opening thereof while the tower assembly is supported by said wheeled car, support means carried by said wheeled car to horizontally position each tower section in a successive manner into a preselected location lying below the bottom opening in the furnace, drive means to vertically displace a tower section from the preselected location relative to said furnace for superimposed engagement and support by an underlying tower section after horizontal positioning thereof by said support means into the preselected location, and means for interconnecting the bottom of a vertically-displaced tower section with the top of an underlying tower section.

12. The apparatus according to claim 11 wherein said support means includes a sleeve extending vertically from said wheeled car, horizontal support arms projecting radially from said sleeve, and means on each support arm for releasably carrying at least one of said plurality of tower sections.

13. The apparatus according to claim 12 wherein said drive means includes a piston and cylinder assembly supported by said wheeled car to extend in a coaxial relation with said sleeve, and releasable support means displaced by said piston and cylinder assembly for vertically displacing a tower section.

14. The apparatus according to claim 12 wherein said drive means includes a piston and cylinder assembly supported to retractably extend from said floor above said wheeled car, and releasable support means displaced by said piston and cylinder assembly for vertically displacing a tower section.

15. An apparatus for facilitating the relining of a metallurgical furnace having a bottom opening spaced above a floor, said furnace being supported for pivotal movement about a horizontal axis by a furnace drive, said apparatus including the combination of:

means adapted to move along said floor while spaced vertically below the bottom opening in said metallurgical furnace, an elongated tower having an extended height to project into said metallurgical furnace by passing through the bottom opening thereof while the tower is supported by said means, hinge means for pivoting a selected length of said tower about a horizontal axis lying below the bottom opening in the furnace in a manner to vertically displace the upper end of the tower, drive means for pivoting the selected length of the tower about the horizontal axis of said hinge means for displacing the upper end of the tower from an elevation lying below the bottom opening in the metallurgical furnace to a vertically-extended position whereby the tower extends into the furnace, and means for controlling said drive means.

16. The apparatus according to claim 15 wherein said elongated tower includes rigid corner posts each having a length corresponding essentially to the vertical height of the tower, brace members for supporting said posts in a generally parallel and spaced-apart relation, and wherein said hinge means pivotally interconnects the corner posts at one side of the tower with said wheeled car.

17. The apparatus according to claim 16 further comprising a work platform adapted to pass through said bottom opening while supported by said elongated tower for positioning within the metallurgical furnace, and elevator means adapted for movement with said tower between said wheeled car and said furnace.

18. The apparatus according to claim 15 wherein said means for controlling said drive means includes a first position transducer to produce an electrical signal corresponding to displacements of said means adapted to move along said floor relative to said furnace, a second position transducer to produce an electrical signal corresponding to the pivotal movement of the metallurgical furnace about a horizontal axis by said furnace drive, a differential amplifier means receiving the electrical signals from said first and second position transducers for producing a control signal, and a controller responsive to said control signal for controlling said drive means to pivot the selected length of the tower.

19. The apparatus according to claim 18 further comprising means responsive to said control signal for controlling movement of said means adapted to move along the floor in a predetermined synchronous relation with pivotal movements by said furnace and said tower.

20. The apparatus according to claim 15 wherein said elongated tower includes upper and lower tower sections each having rigid corner posts interconnected by brace members, the upper tower section being pivotally connected by said hinge means to the lower tower section, and said lower tower section being rigidly supported to extend vertically from said means adapted to move along the floor.

21. The apparatus according to claim 20 wherein said hinge means is constructed and arranged to pivotally interconnect the upper and lower tower sections for pivotal movement about a horizontal axis lying midway between the corner posts at opposite sides of the tower sections, and wherein said drive means includes a cable having the ends thereof connected to the upper tower section at the respective opposite sides which extend parallel to the horizontal pivot axis of said hinge means, and a winch having a driven drum encircled by at least one convolution of said cable.

22. The apparatus according to claim 21 wherein said means adapted to move along the floor supports said winch, and said apparatus further includes means supported by said tower to guide said cable along the extended length of the tower.

23. The apparatus according to claim 15 wherein said means for controlling said drive means includes load responsive means supported at opposite sides of said tower to produce at least one electrical signal corresponding to a force imposed on the tower by the walls of said furnace in response to pivotal movement thereof by said furnace drive, a first controller responsive to said at least one electrical signal to control and drive means, and a second controller responsive to said at least one electrical signal to control movement of said means adapted to move along the floor.

24. The apparatus according to claim 15 wherein said elongated tower includes upper and lower tower sections each having rigid corner posts interconnected by brace members, the lower tower section including a first pair of half tower sections each pivotally connected to said means adapted to move along the floor for positioning of the half tower sections into a vertically-extended and side-by-side relation, a second pair of half tower sections connected by said hinge means to opposite sides of said upper tower section, pivotal means for interconnecting the half tower sections of the first pair with a respective one of the underlying half tower section of the second pair, and means for horizontally moving said pivot means to displace the half tower sections of each pair relative to one another to thereby vertically displace said upper tower section relative to said furnace.

25. An apparatus for facilitating the relining of a metallurgical furnace having a bottom opening spaced above a floor, said furnace being supported for pivotal movement about a horizontal axis by a furnace drive, said apparatus including the combination of:

carrier means spaced vertically below the bottom opening in said metallurgical furnace, an elongated tower including a plurality of tower sections interconnected in and end-to-end relation for defining a tower assembly having an extended height to project from said floor into said metallurgical furnace by passing through the bottom opening thereof while the tower assembly is supported by said carrier means, support means to horizontally position each tower section in a successive manner into a preselected location lying below the bottom opening in the furnace, drive means to vertically displace a tower section from the preselected location relative to said furnace for superimposed engagement and support by an underlying tower section after horizontal positioning thereof by said support means into the preselected location, and means for interconnecting the bottom of a vertically-displaced tower section with the top of an underlying tower section.

26. The apparatus according to claim 25 wherein said support means includes a vertically-arranged sleeve, horizontal support arms projecting radially from said sleeve, and means on each support arm for releasably carrying at least one of said plurality of tower sections.

27. The apparatus according to claim 26 wherein said drive means includes a piston and cylinder assembly extending in a coaxial relation with said sleeve, and releasable support means displaced by said piston and cylinder assembly for vertically displacing a tower section.

28. The apparatus according to claim 26 wherein said drive means includes a piston and cylinder assembly supported to retractably extend from said floor, and releasable support means displaced by said piston and cylinder assembly for vertically displacing a tower section.

* * * * *